US005820448A

United States Patent [19]

Shamouilian et al.

[11] Patent Number: 5,820,448

[45] Date of Patent: Oct. 13, 1998

[54] CARRIER HEAD WITH A LAYER OF CONFORMABLE MATERIAL FOR A CHEMICAL MECHANICAL POLISHING SYSTEM

[75] Inventors: Sam Shamouilian, San Jose; Norm Shendon, San Carlos, both of Calif.

[73] Assignee: Applied Materials, Inc., Santa Clara, Calif.

[21] Appl. No.: 729,298

[22] Filed: Oct. 10, 1996

Related U.S. Application Data

[63] Continuation-in-part of Ser. No. 205,276, Mar. 2, 1994, Pat. No. 5,643,053, which is a continuation-in-part of Ser. No. 173,846, Dec. 27, 1993, Pat. No. 5,582,534.

[51] Int. Cl.[6] ..... B24B 5/00

[52] U.S. Cl. ..... 451/287; 451/41; 451/42; 451/285; 451/286; 451/288; 451/289; 451/390; 451/520

[58] Field of Search ..... 451/285–290, 451/390, 520, 41, 42

[56] References Cited

U.S. PATENT DOCUMENTS

| | | | |
|---|---|---|---|
| 5,584,751 | 12/1996 | Kobayashi et al. . | |
| 5,593,340 | 1/1997 | Nelson et al. | 451/42 |
| 5,605,488 | 2/1997 | Ohashi et al. | 451/288 |
| 5,624,299 | 4/1997 | Shendon et al. . | |
| 5,643,053 | 7/1997 | Shendon et al. . | |

*Primary Examiner*—Robert A. Rose
*Assistant Examiner*—George Nguyen
*Attorney, Agent, or Firm*—Fish & Richardson, P.C.

[57] ABSTRACT

A carrier head for a chemical mechanical polishing apparatus. The carrier head includes a housing with a recess. A flexible membrane defines an enclosed volume in the recess. A conformable material is disposed in the enclosed volume. The conformable material ensures that any load applied to the substrate is evenly distributed.

13 Claims, 6 Drawing Sheets

CARRIER HEAD WITH A LAYER OF CONFORMABLE MATERIAL FOR A CHEMICAL MECHANICAL POLISHING SYSTEM

RELATED APPLICATIONS

This application is a continuation-in-part of U.S. patent application Ser. No. 08/205,276, filed on Mar. 2, 1994, now U.S. Pat. No. 5,643,053 by Norman Shendon, entitled Chemical Mechanical Polishing Apparatus with Improved Polishing Control, which is a continuation-in-part of U.S. patent application Ser. No. 08/173,846, filed on Dec. 27, 1993, now U.S. Pat. No. 5,582,534 by Norman Shendon, entitled Chemical Mechanical Polishing Apparatus. Both applications are hereby incorporated by reference.

BACKGROUND OF THE INVENTION

The invention relates generally to an apparatus for chemical mechanical polishing of a substrate, and more particularly to a carrier head including a layer of conformable material.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly more non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the surface of the substrate is sufficiently non-planar, then the maximum height difference between the peaks and valleys of the outer surface may exceed the depth of focus of the imaging apparatus. As such, it will be impossible to properly focus the light image onto the outer substrate surface.

It may be prohibitively expensive to design new photolithographic devices having an improved depth of focus. In addition, as the feature size used in integrated circuits becomes smaller, shorter wavelengths of light must be used, further reducing of the available depth of focus. Therefore, there is a need to periodically planarize the substrate surface to provide a substantially planar layer surface.

Chemical mechanical polishing (CMP) is one accepted method of planarization. This planarization method typically requires that the substrate be mounted to a carrier or polishing head. The exposed surface of the substrate is then placed against a rotating polishing pad. The carrier provides a controllable load, i.e., pressure, on the substrate to push it against the polishing pad. In addition, the carrier may rotate to provide additional motion between the substrate and polishing pad. A polishing slurry, including an abrasive and a chemically-reactive agent, is distributed over the polishing pad to provide an abrasive chemical solution at the interface between the pad and substrate. A CMP process is fairly complex, and differs from simple wet sanding. In a CMP process the reactive agent in the slurry reacts with the outer surface of the substrate to form reactive sites. The interaction of the polishing pad and abrasive particles with the reactive sites results in polishing.

An effective chemical mechanical polishing process has a high polishing rate and generates a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. Because inadequate flatness and finish can create defective substrates, the selection of a polishing pad and slurry combination is usually dictated by the required finish and flatness. Given these constraints, the polishing rate sets the maximum throughput of the polishing apparatus.

The polishing rate depends upon the force pressing the substrate against the pad. Specifically, the greater this pressure, the faster the substrate is polished. If the carrier applies a non-uniform load, i.e., if the carrier applies more pressure to one region of the substrate than to another, then the higher pressure regions will be polished faster than the lower pressure regions. Therefore, a non-uniform load may result in non-uniform polishing of the substrate.

An additional consideration in the production of integrated circuits is process and product stability. To achieve a high yield, i.e., a low defect rate, each successive substrate should be polished under substantially similar conditions. Each substrate, in other words, should be polished approximately the same amount so that each integrated circuit is substantially identical.

In view of the foregoing, there is a need for a chemical mechanical polishing apparatus which optimizes polishing throughput while providing the desired surface, flatness and finish. The chemical mechanical polishing apparatus should include a carrier which applies a substantially uniform load to the substrate.

SUMMARY OF THE INVENTION

In general, in one aspect, the invention features a carrier head for a chemical mechanical polishing apparatus. The carrier comprises a housing having a recess. A flexible membrane defines an enclosed volume in the recess, and a conformable material is disposed within the enclosed volume. The membrane has a mounting surface for the substrate.

Implementations of the invention include the following. The membrane may be rubber and the conformable material may be silicone or gelatin. The membrane may encapsulate the conformable material. The membrane may be connected to a backing member. A loading mechanism may connect the backing member to the housing to press the substrate against the polishing pad. A source may be connected to the enclosed volume to supply material to the enclosed volume. A flexible fluid connector may connect the source to the enclosed volume through a pressure chamber. A retaining ring may form a portion of the recess.

In general, in another aspect, the invention features a carrier head for a chemical mechanical polishing apparatus. The carrier comprises a housing having a recess. A first flexible membrane portion defines a first enclosed volume in the recess and a second flexible membrane portion defines a second enclosed volume in the recess. A first conformable material having a first viscosity is disposed in the first enclosed volume, and a second conformable material having a second viscosity is disposed in the second enclosed volume.

Advantages of the invention include the following. The carrier provides uniform loading of the backside of the substrate to evenly polish the substrate. The conformable material deforms and redistributes its mass if the polishing pad is tilted, the substrate is warped, or there are irregularities on the backside of the substrate or the underside of the rigid surface.

Other advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The accompanying drawings, which are incorporated in and constitute a part of the specification, schematically illustrate embodiments of the invention, and together with the general description given above and the detailed description of the embodiments given below, serve to explain the principles of the invention.

DESCRIPTION OF THE PREFERRED EMBODIMENT(S)

Figure 1:
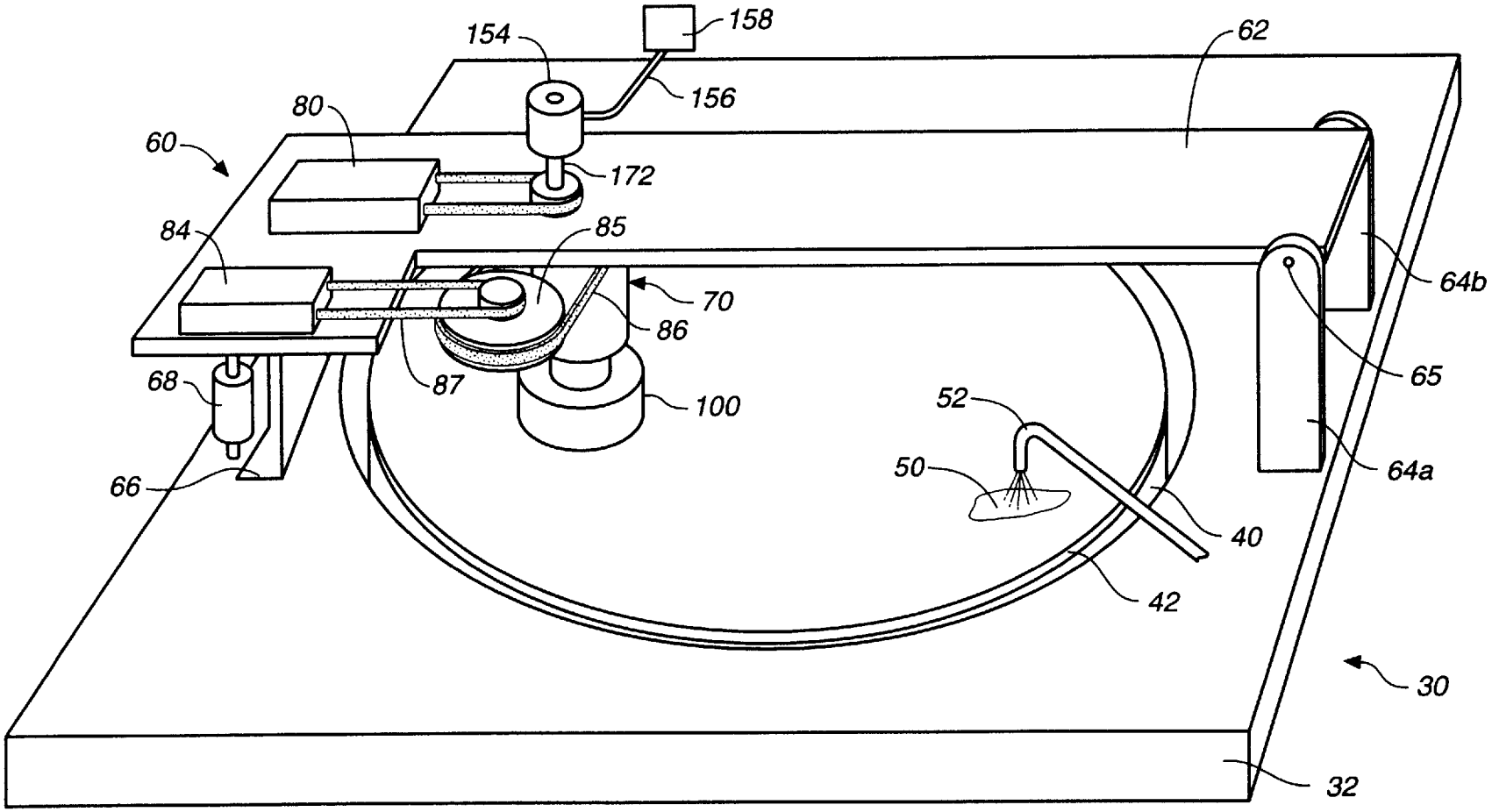
FIG. 1 is a schematic perspective view of a chemical mechanical polishing apparatus.
Figure 2:
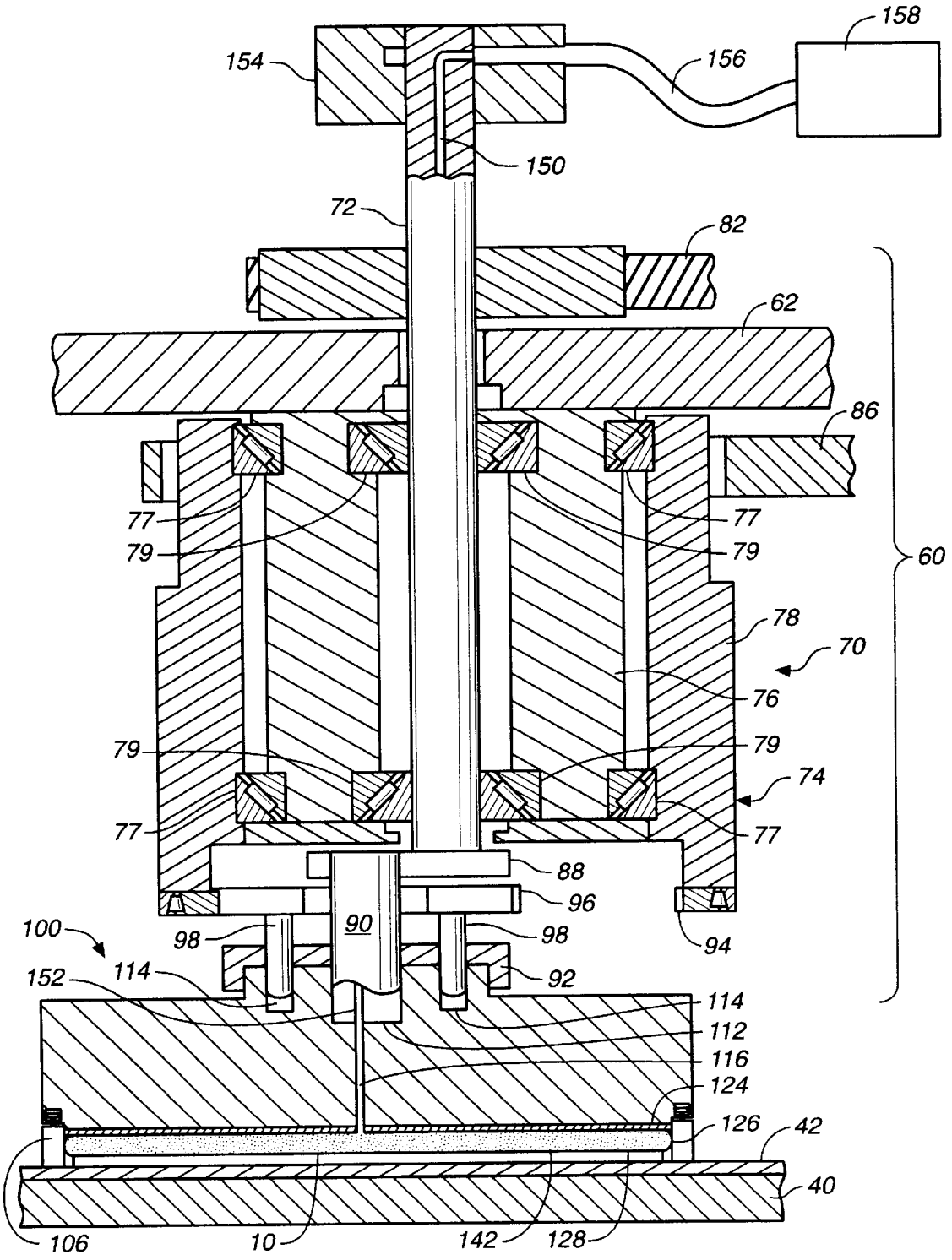
FIG. 2 is a cross-sectional view of the support assembly, carrier head and polishing pad of the chemical mechanical apparatus of FIG. 1.

Referring to FIGS. 1 and 2, a chemical mechanical polishing (CMP) apparatus 30 generally includes a base 32 which supports a rotatable platen 40 and a polishing pad 42. The CMP apparatus 30 further includes a carrier or carrier head 100 which receives a substrate 10 and positions the substrate on the polishing pad. A support assembly 60 connects carrier head 100 to base 32. The carrier head is positioned against the surface of the polishing pad by support assembly 60.

If substrate 10 is an eight-inch (200 mm) diameter disk, then platen 40 and polishing pad 42 will be about twenty inches in diameter. Platen 40 is preferably a rotatable aluminum or stainless steel plate connected by a drive shaft (not shown) to a drive mechanism (also not shown). The drive shaft may also be stainless steel. The drive mechanism, such as a motor and gear assembly, is positioned inside the base to rotate the platen and the polishing pad. The platen may be supported on the base by bearings, or the drive mechanism may support the platen. For most polishing processes, the drive mechanism rotates platen 40 at thirty to two-hundred revolutions per minute, although lower or higher rotational speeds may be used.

Figure 3A:
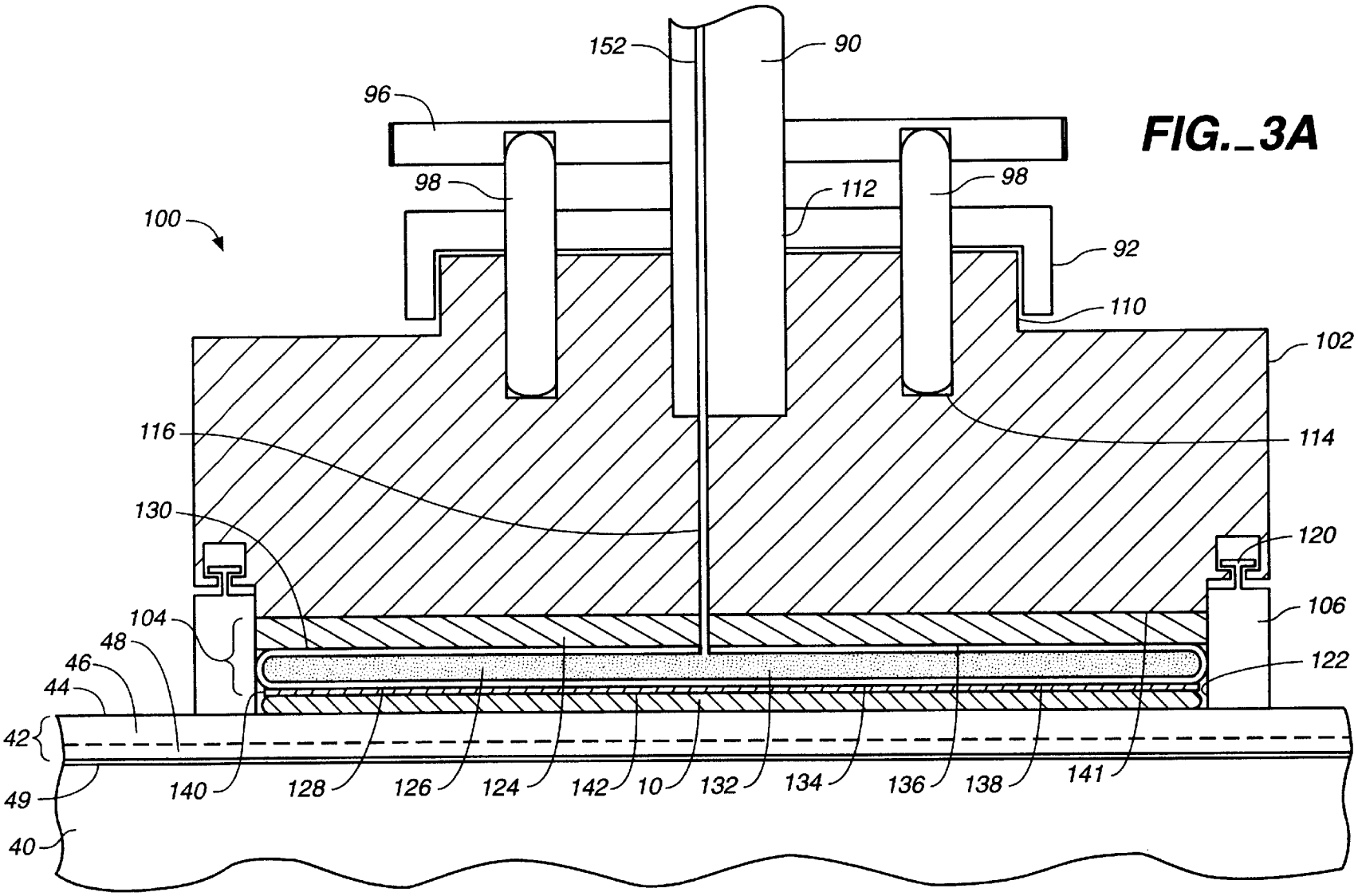
FIG. 3A is a schematic cross-sectional view of the carrier head and polishing pad of the chemical mechanical apparatus of FIG. 1.

Referring to FIG. 3A, polishing pad 42 may be a hard composite material having a roughened polishing surface 44. The polishing pad 42 may be attached to platen 40 by a pressure-sensitive adhesive layer 49. Polishing pad 42 may have a fifty mil thick hard upper layer 46 and a fifty mil thick softer lower layer 48. Upper layer 46 is preferably a material composed of polyurethane mixed with other fillers. Lower layer 48 is preferably a material composed of compressed felt fibers leached with urethane. A common two-layer polishing pad, with the upper layer composed of IC-1000 and the lower layer composed of SUBA-4, is available from Rodel, Inc., Newark, Del. (IC-1000 and SUBA-4 are product names of Rodel, Inc.).

Referring to FIG. 1, a slurry 50 containing a reactive agent (e.g., deionized water for oxide polishing), abrasive particles (e.g., silicon dioxide for oxide polishing) and a chemically reactive catalyzer (e.g., potassium hydroxide for oxide polishing) is supplied to the surface of polishing pad 42. A slurry supply tube or port 52 distributes or otherwise meters the slurry onto the polishing pad. The slurry may also be pumped through passages (not shown) in platen 40 and polishing pad 42 to the underside of substrate 10.

To properly position the carrier head with respect to the polishing pad, support assembly 60 includes a crossbar 62 that extends over the polishing pad. Crossbar 62 is positioned above the polishing pad by a pair of opposed upright members 64*a*, 64*b* and 66, and a biasing piston 68. One end of crossbar 62 is connected to upright members 64*a* and 64*b* by means of a hinge 65. The other end of crossbar 62 is connected to the biasing piston 68. The biasing piston may lower and raise crossbar 62 in order to control the vertical position of the carrier head. The second upright member 66 is positioned adjacent to the biasing piston 68 to provide a vertical stop which limits the downward motion of the crossbar.

To place a substrate on carrier head 100, the crossbar is disconnected from the biasing piston, and the crossbar is rotated about hinge 65 to lift carrier head 100 off the polishing pad. The substrate is then placed in the carrier head, and the carrier head is lowered to place substrate 10 against polishing surface 44 (see FIG. 3A).

Support assembly 60 includes a transfer case 70 which is suspended from crossbar 62 to controllably orbit and rotate the substrate about the polishing pad. The transfer case 70 includes a drive shaft 72 and a housing 74. The housing 74 includes a fixed inner hub 76 and an outer hub 78. The fixed inner hub 76 is rigidly secured to the underside of crossbar 62, for example by a plurality of bolts (not shown). The rotatable outer hub 78 is journalled to fixed inner hub 76 by upper and lower tapered bearings 77. These bearings provide vertical support to rotatable outer hub 78, while allowing it to rotate with respect to the fixed inner hub. The drive shaft 72 extends through fixed inner hub 76 and is also vertically supported by tapered bearings 79 which allow the drive shaft 72 to rotate with respect to the fixed inner hub 76.

As discussed in aforementioned U.S. patent application Ser. No. 08/173,846, a first motor and gear assembly 80 is connected to drive shaft 72 to control the orbital motion of the carrier head, and a second motor and gear assembly 84 is connected by means of a pulley 85 and drive belts 86 and 87 to rotatable outer hub 78 to control the rotational motion of the carrier head. One end of a horizontal cross arm 88 is connected to the lower end of drive shaft 72. The other end of crossarm 88 is connected to the top of a secondary vertical drive shaft 90. The bottom of secondary drive shaft 90 fits into a cylindrical depression 112 in the carrier head. Thus, when drive shaft 72 rotates, it sweeps secondary drive shaft 90 and carrier head 100 in an orbital path.

Support assembly 60 also includes a rotational compensation assembly to control the rotational speed of carrier head 100. The compensation assembly includes a ring gear 94 which is connected to the bottom of rotatable outer hub 78 of housing 74, and a pinion gear 96 connected to secondary drive shaft 90 immediately below cross arm 88. Ring gear 94 has an inner toothed surface, and the pinion gear 96 includes an outer toothed surface which engages the inner toothed surface of ring gear 94. As cross arm 88 pivots, it sweeps pinion gear 96 around the inner periphery of ring gear 94. A pair of dowel pins 98 extend from the pinion gear 96 into a pair of mating dowel pin holes 114 in the carrier head to rotationally fix the pinion gear with respect to the carrier head. Thus, the rotational motion of rotatable outer hub 78 is transferred to carrier head 100 through ring gear 94, pinion gear 96, and pins 98.

The compensation assembly allows the user of CMP apparatus 30 to vary both the rotational and orbital components of motion of the carrier head, and thereby control the rotation and orbit of substrate 10. By rotating rotatable outer hub 78 while simultaneously rotating drive shaft 72, the effective rotational motion of carrier head 100 may be controlled. Carrier head 100 and substrate 10 may be caused to rotate, orbit, or rotate and orbit. The carrier head rotates or orbits at about thirty to two-hundred revolutions per minute (rpm).

As the substrate orbits, the polishing pad may be rotated. Preferably, the orbital radius is no greater than one inch, and the polishing pad rotates at a relatively slow speed, e.g., less than ten rpm and more preferably at less than five rpm. The orbit of the substrate and the rotation of the polishing pad combine to provide a nominal speed at the surface of the substrate of 1800 to 4800 centimeters per minute.

A substrate is typically subjected to multiple polishing steps including a main polishing step and a final polishing step. For the main polishing step, carrier head 100 applies a force of approximately four to ten pounds per square inch (psi) to substrate 10, although carrier head 100 may apply more or less force. For a final polishing step, carrier head 100 may apply about three psi.

Generally, carrier head 100 transfers torque from the drive shaft to the substrate, uniformly loads the substrate against the polishing surface and prevents the substrate from slipping out from beneath the carrier head during polishing operations.

As shown in more detail in FIG. 3A, carrier head 100 includes three major assemblies: a housing assembly 102, a substrate loading assembly 104, and a retaining ring assembly 106.

The housing assembly 102 is generally circular so as to match the circular configuration of the substrate to be polished. The housing assembly 102 may be machined aluminum. The top surface of housing assembly 102 includes a cylindrical hub 110 having cylindrical recess 112 for receiving secondary drive shaft 90. At least one passageway 116 connects recess 112 to the bottom of housing assembly 102.

As shown in FIG. 2, drive shaft 72 includes one or more channels 150 and secondary drive shaft 90 includes one or more channels 152, to provide fluid or electrical connections to the carrier head. A rotary coupling 154 at the top of drive shaft 72 couples channel(s) 150 to one or more fluid or electrical lines 156. For instance, one of lines 156 may be a conformable material supply line as described below. Another rotary coupling (not shown) in cross arm 88 connects channel(s) 150 in drive shaft 72 to channel(s) 152 in secondary drive shaft 90. As shown, passageway 116 passes through housing assembly 102 to connect to channel 152 to substrate loading assembly 104.

As the polishing pad rotates, it tends to pull the substrate out from beneath the carrier head. Therefore, carrier head 100 includes a retaining ring assembly 106 which projects downwardly from housing assembly 102 and extends circumferentially around the outer perimeter of the substrate. The retaining ring assembly 106 may be attached with a key-and-keyway assembly 120 to housing assembly 102 so that the retaining ring assembly rests on the polishing pad and is free to adjust to variations in the height of the polishing surface 44. An inner edge 122 of retaining ring assembly 106 captures the substrate so that the polishing pad cannot pull the substrate from beneath the carrier head. Retaining ring assembly 106 may be made of a rigid plastic material.

Substrate loading assembly 104 is located beneath housing assembly 102 in the recess formed by retaining ring assembly 106. Substrate loading assembly 104 may include a removable carrier plate 124, a membrane 134 which defines an enclosed volume 126, and a removable carrier film 128. Enclosed volume 126 may be located in the cylindrical recess surrounded by retaining ring assembly 106.

The removable carrier plate 124 may be a circular stainless-steel disk of approximately the same diameter as the substrate. The lower surface of the carrier plate, or the lower surface of the housing if the carrier plate is not present, provides a face 130 to which membrane 134 may be adhesively attached.

The enclosed volume 126 is filled with a conformable material 132. The conformable material 132 is a non-gaseous material which undergoes viscous, elastic, or viscoelastic deformation under pressure. Preferably, conformable material 132 is a viscoelastic material, such as a silicon, a gelatin, or another substantially resilient yet viscous substance which will redistribute its mass under pressure. The pressure applied during polishing is substantially uniformly distributed across substrate 10 by means of the conformable material in enclosed volume 126.

Figure 3B:
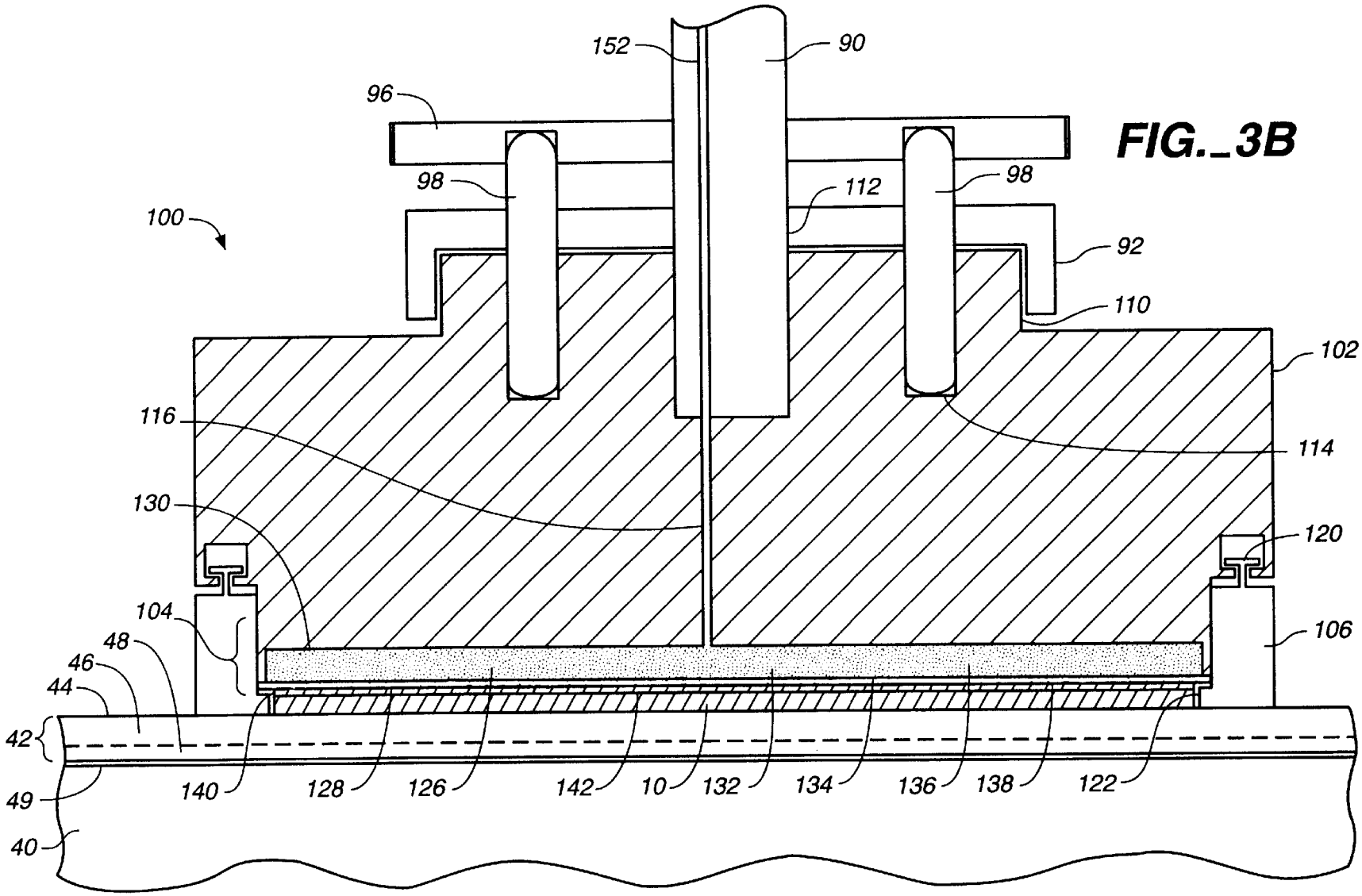
FIG. 3B is a schematic cross-sectional view of an alternate carrier head.

As shown in FIG. 3A, membrane 134 defines enclosed volume 126. The membrane is comprised of a flexible, stretchable and compressible material such as rubber. Membrane 134 may entirely encapsulate conformable material 132. An upper surface 136 of membrane 134 is placed against face 130. Alternately, as shown in FIG. 3B, the enclosed volume may be formed by extending the membrane across the recess beneath face 130 and filling the enclosed volume with conformable material 132.

Carrier film 128 may be attached to a lower surface 138 of membrane 134. Carrier film 128 is formed of a thin circular layer of a porous material such as urethane. Carrier film 128, if used, is sufficiently thin and flexible that it substantially conforms to the surface of substrate 10. Carrier film 128 provides a mounting surface 142 to which substrate 10 is releasably adhered by surface tension. Alternately, if the carrier film is not used, the lower surface of membrane 134 may be porous to accomplish the same thing (see FIG. 5). Carrier film 128 is sufficiently thin and flexible so that it substantially conforms to the surface of substrate 10.

The space defined by retaining ring assembly 106 and mounting surface 142 provides a substrate receiving recess 140. The substrate is placed against mounting surface 142, causing conformable material 132 and carrier film 128, if present, to deform to contact the substrate across its entire backside. Carrier head 100 is then lowered to bring the substrate into contact with polishing surface 44. The load applied to the substrate is transferred through conformable material 132.

The polishing surface 44 may be non-planar; e.g., it may have sloping contours. Carrier plate 124 and the underside or surface 141 of housing assembly 102 may also be non-planar. The polishing pad may be tilted relative to the carrier head. In addition, the backside of substrate 10 may have surface irregularities. The substrate could also be warped. The conformable material 132 ensures a uniform distribution of the carrier load on the substrate for both large scale effects (e.g., a tilted polishing pad) and small scale effects (e.g., surface irregularities on the backside of the substrate). Conformable material 132 conforms to the substrate surface as well as to face 130. That is, the conformable material inside membrane 134 redistributes its mass to conform to surface irregularities on the backside of the substrate and face 130. Because the conformable material contacts substrate across its entire back surface, and because the conformable material has a uniform density, it ensures a uniform load across the backside of the substrate. In addition, conformable material 132 may flow and deform. This permits the substrate to tilt with respect to housing assembly 102 to follow the contours of the polishing pad. In summary, the conformable material ensures that carrier head 100 uniformly loads the substrate against the polishing surface 44.

When carrier head 100 rotates at high speeds, centrifugal force will tend to push the conformable material in the enclosed volume outwardly toward the edge of the carrier head. This tends to increase the density of the conformable material near the perimeter of enclosed volume. Consequently, the conformable material near the edge of the enclosed volume will tend to become less compressible than the center, and a non-uniform load may be applied to the substrate.

To prevent this non-uniform load, enclosed volume 126 is connected by passageway 116, channels 150 and 152, and conformable material supply line 156 to a supply 158. Supply 158 can provide conformable material at a constant pressure to enclosed volume 126. Consequently, when carrier head 100 rotates and conformable material 132 is forced toward the edge of the enclosed volume, supply 158 provides additional conformable material to the center of the enclosed volume and maintains the conformable material at a substantially uniform distribution throughout enclosed volume 126. This uniform distribution of conformable material ensures uniform polishing at the center and edges of the substrate.

Supply 158 may also be used to control the viscosity of conformable material 132. By increasing the pressure on the conformable material, the density of conformable material 132 can be increased. If the density of conformable material 132 increases, its viscosity will decrease.

The minimum pressure from supply 158 must overcome the load applied by the carrier head to the substrate; otherwise, this load will force the conformable material back through passageway 116. When the carrier head stops rotating, the conformable material is uniformly re-distributed throughout membrane 134. The excess conformable material then flows back through passageways 116, 150 and 152 to supply 158.

In another implementation, conformable material 132 may be a material, such as rubber, which is sufficiently rigid that it does not flow under the influence of centrifugal forces. In this implementation, the distribution of conformable material 132 does not change significantly when carrier head 100 rotates. Thus, conformable material supply 158 is not required.

Figure 4:
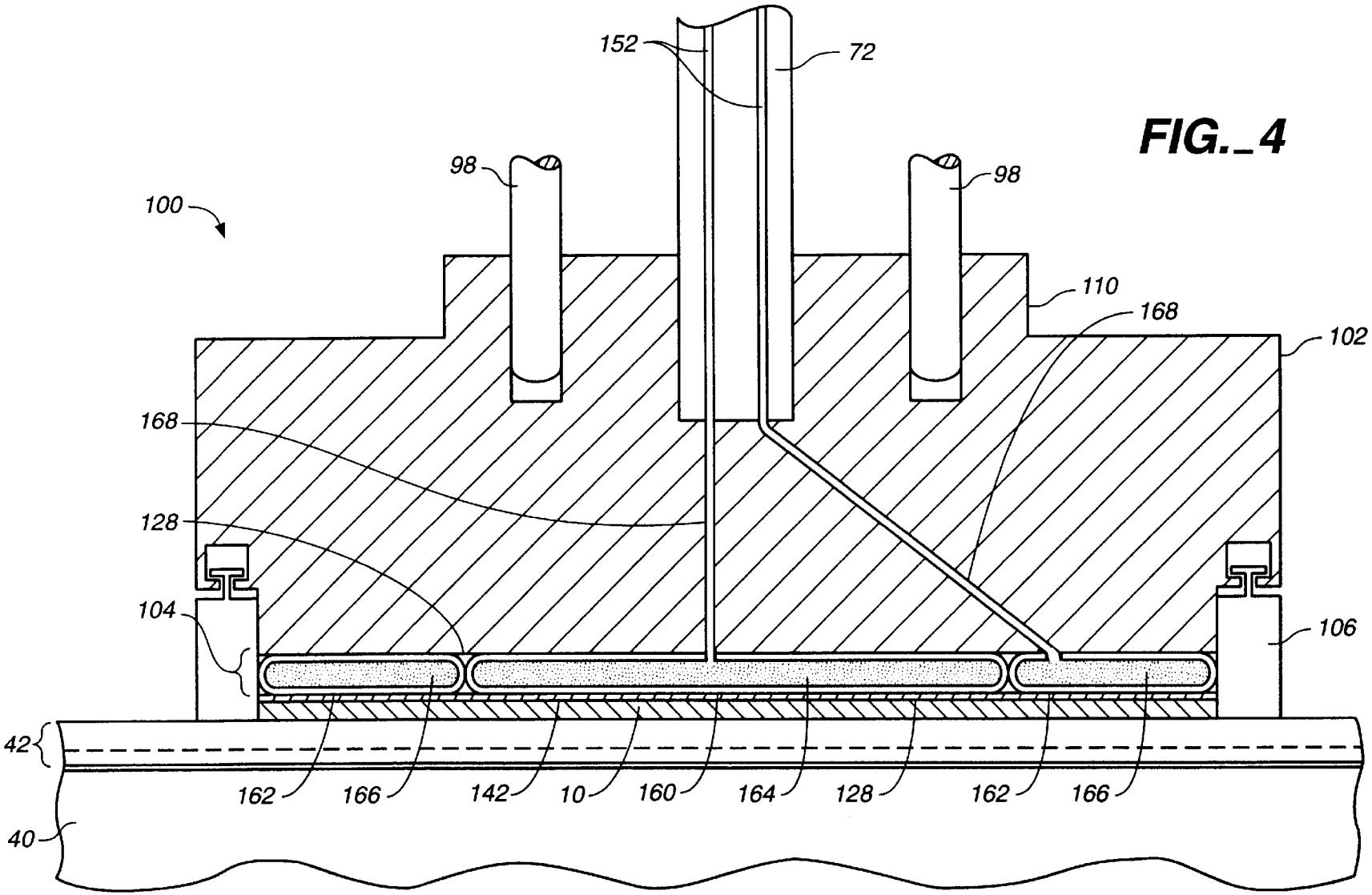
FIG. 4 is a schematic cross-sectional view of a carrier head having multiple enclosed volumes filled with a conformable material.

As shown in FIG. 4, substrate loading assembly 104 may include multiple compartments or enclosed volumes 160 and 162. The enclosed volumes 160 and 162 are defined by two or more membrane portions. The membrane portions may be separate, discrete membranes, or they may be different portions of a single membrane. Enclosed volume 160 may be a circular disk, located above the center of mounting surface 142, and enclosed volume 162 may be an annular ring surrounding enclosed volume 160. The enclosed volumes 160 and 162 contain conformable materials 164 and 166, respectively. Conformable materials 164 and 166 have different viscosities. By selecting the relative viscosities of conformable materials 164 and 166, over-polishing of the substrate edge may be avoided and more uniform polishing of the substrate may be achieved. Each enclosed volume may be connected by a passageway 168 to a supply (not shown).

Figure 5:
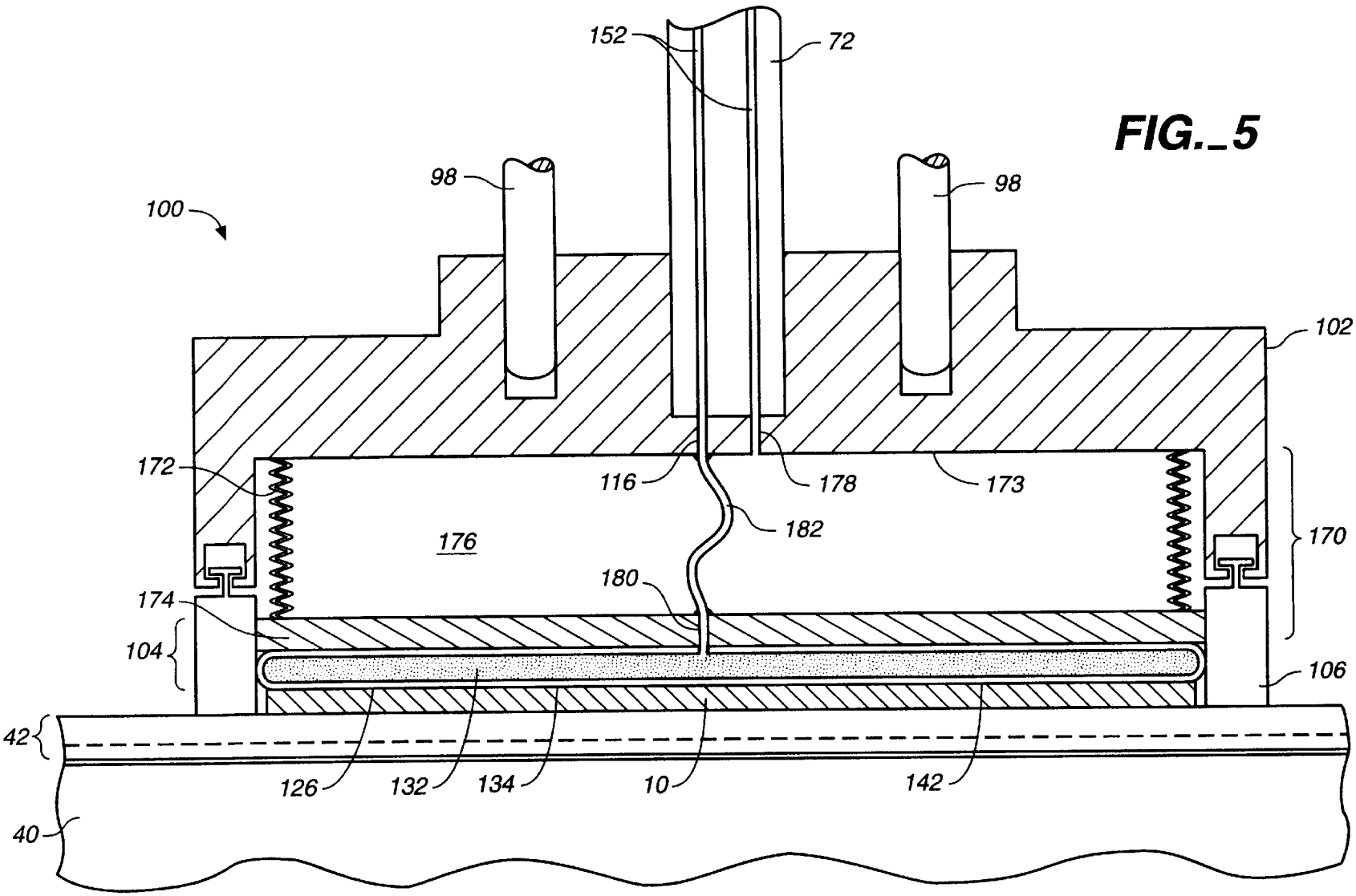
FIG. 5 is a schematic cross-sectional view of a carrier head having a loading mechanism.

Referring to FIG. 5, carrier head 100 may be held in a vertically-fixed position by support assembly 60 (see FIG. 3A), and a force may be applied to substrate 10 by the carrier head. In this embodiment, the loading assembly 104 includes a flexible connector, such as a bellows 170. The bellows 170 connects a substrate backing member 174 to a bottom surface 173 of housing assembly 102. The bellows 170 is expandable so that substrate backing member 174 can move vertically relative to housing assembly 102. The interior of bellows 170 forms a pressure chamber 176. Pressure chamber 176 can be pressurized negatively or positively by a pressure or vacuum source (not shown) which is connected to pressure chamber 176 by a conduit 178. Membrane 134 is attached to the bottom face of substrate backing member 174. By pressurizing chamber 176, a force is exerted on conformable material 132 to press the substrate against the polishing pad. Thus, flexible connector 170 acts as a loading mechanism, and replaces the biasing piston 68.

Enclosed volume 126 may be connected to a supply as shown in the embodiment of FIG. 2. A flexible conduit 182, which may be a plastic tubing, connects a passageway 180 in substrate backing member 174 to passageway 116 in housing assembly 102 for this purpose. The points at which flexible conduit 182 is connected to passageways 180 and 116 may be sealed by appropriate fittings to prevent conformable material 132 from leaking into pressure chamber 176.

The present invention has been described in terms of a preferred embodiment. The invention, however, is not limited to the embodiment depicted and described. Rather, the scope of the invention is defined by the appended claims.

What is claimed is:

1. A carrier head for positioning a substrate on a polishing surface of a chemical mechanical polishing apparatus, comprising:

a housing forming a recess;

a flexible membrane defining an enclosed volume in said recess, said membrane having a mounting surface for said substrate; and a conformable viscoelastic material disposed within said enclosed volume.

2. The carrier head of claim 1 further comprising a backing member to which said membrane is attached.

3. The carrier head of claim 2 further comprising a flexible connector connecting said backing member to said housing.

4. The carrier head of claim 1 wherein said membrane is rubber.

5. The carrier head of claim 1 wherein said conformable viscoelastic material is selected from the group consisting of silicone and gelatin.

6. The carrier head of claim 1 wherein said membrane encapsulates said conformable viscoelastic material to form said enclosed volume.

7. The carrier head of claim 1 further comprising a retaining ring, said retaining ring forming at least a portion of said recess.

8. The carrier head of claim 1 further comprising a source connected to said enclosed volume to supply the conformable viscoelastic material thereto.

9. A carrier for positioning a substrate on a polishing surface of a chemical mechanical polishing apparatus, comprising:

a housing having a recess;

a first flexible membrane portion defining a first enclosed volume in said recess;

a second flexible membrane portion defining a second enclosed volume in said recess;

a first conformable material having a first viscosity disposed in said first enclosed volume; and a second conformable material having a second viscosity different from said first viscosity and disposed in said second enclosed volume.

10. A carrier for positioning a substrate on a polishing surface of a chemical mechanical polishing apparatus, comprising:

a housing;

a backing member which is vertically movable relative to said housing;

a flexible connector connecting said backing member to said housing for controlling the vertical position of said backing member;

a flexible membrane defining an enclosed volume beneath said backing member, said membrane having a mounting surface for said substrate; and a conformable viscoelastic material disposed in said enclosed volume.

11. The carrier head of claim 10 wherein said flexible connector defines a pressure chamber between said housing and said backing member.

12. The carrier head of claim 11 further comprising a source connected to said enclosed volume to supply the material to said enclosed volume.

13. The carrier head of claim 12 further comprising a flexible conduit disposed in said pressure chamber to connect said source to said enclosed volume.

* * * * *

UNITED STATES PATENT AND TRADEMARK OFFICE

CERTIFICATE OF CORRECTION

PATENT NO. : 5,820,448

DATED : 10/13/98

INVENTOR(S) : Shamouilian et al.

It is certified that error appears in the above-identified patent and that said Letters Patent is hereby corrected as shown below:

Title page

After "Inventors:" change "Sam" to --Shamouil--.

After "U.S. PATENT DOCUMENTS" Insert

| | | |
|---|---|---|
| --4270316 | 6/1981 | Kramer et al. |
| 4373991 | 2/1983 | Banks |
| 4519168 | 5/1985 | Cesna |
| 4669226 | 6/1987 | Mandler |
| 4918869 | 4/1990 | Kitta |
| 4954142 | 9/1990 | Carr et al. |
| 5081795 | 1/1992 | Tamaka et al. |
| 5193316 | 3/1993 | Olmstead |
| 5205082 | 4/1993 | Shendon et al. |
| 5230184 | 7/1993 | Bukhman |
| 5255474 | 10/1993 | Gawa et al. |
| 5423558 | 6/1995 | Koeth et al. |
| 5423716 | 6/1995 | Strasbau |
| 5441444 | 8/1995 | Nakajima |
| 5443416 | 8/1995 | Volodarsky et al.-- |

UNITED STATES PATENT AND TRADEMARK OFFICE

CERTIFICATE OF CORRECTION

PATENT NO. : 5,820,448

DATED : 10/13/98

INVENTOR(S) : Shamouilian et al.

It is certified that error appears in the above-identified patent and that said Letters Patent is hereby corrected as shown below:

Insert --FOREIGN PATENT DOCUMENTS 224 3263 9/1990 Japan
61 25768 2/1986 Japan--.

Column 1, line 45, after "reducing" delete "of";
Column 6, line 28, change "silicon" to --silicone--.

Signed and Sealed this

Twenty-fifth Day of May, 1999

*Attest:*

Q. TODD DICKINSON

*Attesting Officer*

*Acting Commissioner of Patents and Trademarks*